US008267711B2

(12) United States Patent
Walker et al.

(10) Patent No.: US 8,267,711 B2
(45) Date of Patent: Sep. 18, 2012

(54) POSITIVE SAFETY LATCH

(75) Inventors: Kevin E. Walker, Hershey, PA (US); John P. Huss, Jr., Harrisburg, PA (US); Gottlieb O. Oyster, Hummelstown, PA (US); Shane W. Wiest, Shermans Dale, PA (US)

(73) Assignee: Phoenix Contact Development & Manufacturing Inc., Middleton, PA (US)

( * ) Notice: Subject to any disclaimer, the term of this patent is extended or adjusted under 35 U.S.C. 154(b) by 81 days.

(21) Appl. No.: 12/902,140

(22) Filed: Oct. 11, 2010

(65) Prior Publication Data

US 2012/0088387 A1 Apr. 12, 2012

(51) Int. Cl.
*H01R 13/625* (2006.01)

(52) U.S. Cl. ..... 439/345

(58) Field of Classification Search ..... 439/953, 439/345, 378, 372

See application file for complete search history.

(56) References Cited

U.S. PATENT DOCUMENTS

| | | | | |
|---|---|---|---|---|
| 3,350,680 | A | 10/1967 | Benoit et al. | |
| 3,382,558 | A | 5/1968 | Lutz et al. | |
| 5,014,416 | A * | 5/1991 | Reynolds | 29/701 |
| 5,109,453 | A * | 4/1992 | Edwards et al. | 385/90 |
| 5,791,932 | A | 8/1998 | Hasenfratz | |
| 6,033,250 | A * | 3/2000 | Pauza | 439/357 |
| 6,149,451 | A | 11/2000 | Weber | |
| 6,319,052 | B1 * | 11/2001 | Chang | 439/495 |
| 6,655,978 | B2 * | 12/2003 | Lutsch et al. | 439/352 |
| 7,387,525 | B1 * | 6/2008 | Huang | 439/352 |
| 7,652,210 | B2 * | 1/2010 | White | 174/67 |
| 2010/0233904 | A1 | 9/2010 | Stone et al. | |

OTHER PUBLICATIONS

U.S. Patent & Trademark Office, International Search Report in International Patent Application No. PCT/US2011/055686 (Feb. 1, 2012).

* cited by examiner

*Primary Examiner* — Tulsidas C Patel
*Assistant Examiner* — Phuongchi Nguyen
(74) *Attorney, Agent, or Firm* — Leydig, Voit & Mayer, Ltd.

(57) ABSTRACT

An electronic connector latch system provides safety via an internally hidden latch that requires a correctly sized pin to open. The described system is positive, in that it provides a "deadbolt" style latching wherein the pull out force is perpendicular to direction of opening the latch, and latching occurs on both sides of the locking post. The system is still user friendly in that mating the two connectors together can be accomplished without any tools. Mating is achieved with a simple insertion of the mating connector. The latch is captured inside the plastic unit housing, and a stamped sheet metal spring provides high cycle life.

18 Claims, 9 Drawing Sheets

POSITIVE SAFETY LATCH

FIELD

This present invention relates to electrical connectors, and more particularly to a positive safety latch for making and unmaking a power connection.

BACKGROUND

In many electrical power environments, components and conductors are typically provided and installed in a modular manner, such that the various parts must eventually be mated, or electrically connected, with suitable connectors. In high-power or critical applications, it is important that the connectors be positive and reliable, while also allowing for a connection to be unmade if necessary.

By way of example, connectors used in the solar industry to connect photovoltaic (PV) modules in series utilize a latching system that require a tool to separate the mated connectors. This safety requirement is typical for single pole DC Solar connectors; however there is a need for a multi-pole AC Solar system that requires a tool for disconnection. This is especially true, for example, in applications involving micro-inverters.

The latching system must be rugged to withstand the harsh environment of solar applications, provide high durability for many mating cycles, be cost effective, and be easy for installers to make and unmake connectors.

Thus, it is an object underlying certain implementations of the described principles to provide a system for efficiently and effectively avoiding the above-noted problems where applicable. However, while this is an object underlying certain implementations of the invention, it will be appreciated that the invention is not limited to systems that solve the problems noted herein. Moreover, the inventors have created the above body of information for the convenience of the reader and expressly disclaim all of the foregoing as prior art; the foregoing is a discussion of problems discovered and/or appreciated by the inventors, and is not an attempt to review or catalog the prior art.

SUMMARY

In an embodiment of the invention, a multi-pole AC Solar system latch system is provided that provides safety via an internally hidden latch that requires a special tool or correctly sized pin to open. The described system is positive, in that it provides a "deadbolt" style latching. Pull out force is perpendicular to direction of opening the latch, and latching occurs on both sides of the locking post.

While unlatching the connection is made secure, the system is still very user friendly in that mating the two connectors does not require any tools. Mating is achieved with a simple straight forward insertion of the mating connector. The latch is captured inside the plastic unit housing, and a stamped sheet metal spring provides high cycle life. In an embodiment of the invention the lead-in construction provides a smooth surface for inserting the mating connector. Finally, the device is configurable, in that the spring thickness and width can be modified to optimize spring force in a given application.

Although various embodiments of the invention are applicable to multi-pole AC Solar system connections, other objects and advantages of the invention will become apparent upon reading the following detailed description and upon reference to the drawings.

DETAILED DESCRIPTION

As noted above, in an embodiment of the invention, a latch system is provided that operates via an internally hidden latch that gives a "deadbolt" type latching, wherein the pull out force is perpendicular to direction of opening the latch, and latching occurs on both sides of a locking post. Other features will be appreciated from the following detailed description and figures. In an embodiment, the referenced connectors are specifically configured for a multi-pole AC Solar system, and the type and number of connections and conductors in such systems will be familiar to those of skill in the art.

Figure 1:
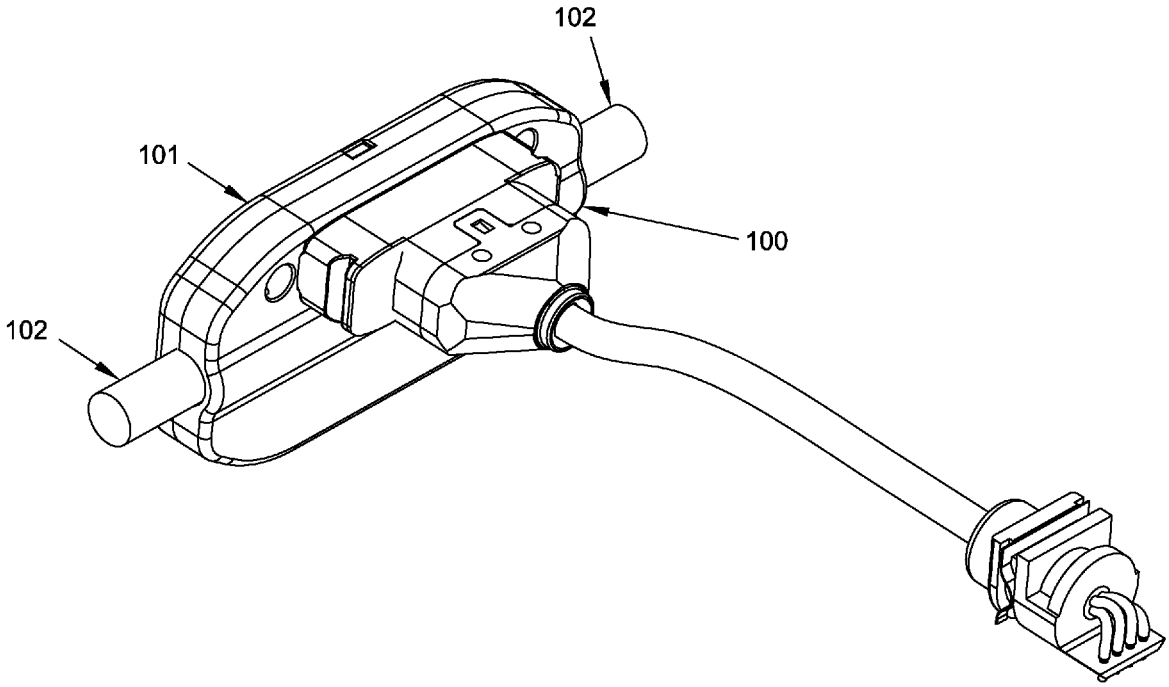
FIG. 1 is an external perspective view of a latch and its usage environment according to an embodiment of the invention, including a mating connector or cable assembly, connector body, and unlocking pins.

Referring now to FIG. 1, this figure shows an external perspective view of the latch in its usage environment. As shown, a mating connector or cable assembly 100 latches into a connector body 101. In a further embodiment, unlocking pins 102 are provided within the connector body 101.

Figure 2:
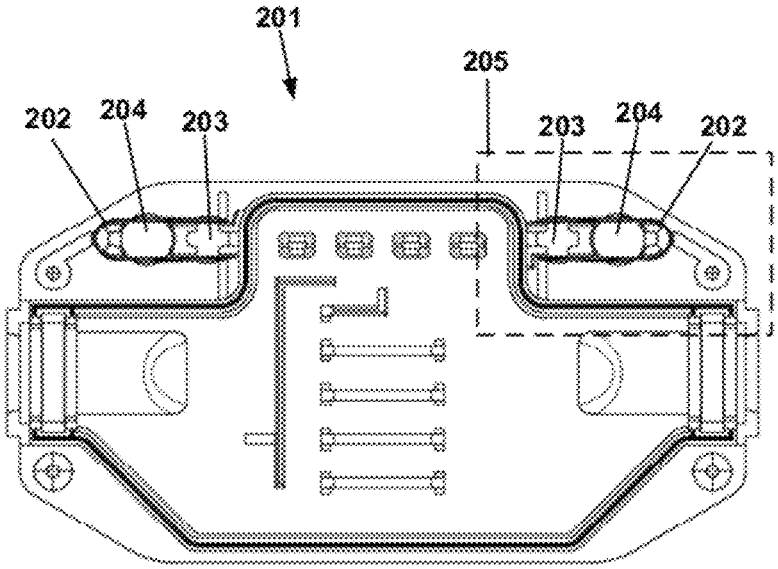
FIG. 2 is a schematic front elevation of the connector body.

FIG. 2 is a schematic front elevation of the connector body 101 (201). The connector body 201 includes internal locking springs 202 for latching onto locking pins of the mating connector assembly 100 (FIG. 1). The connector body 201 also includes guides 203 for the locking pins, as well as guides 204 for the disconnect pins or tool, which requires access to the locking springs 202 to open them.

Figure 3A:
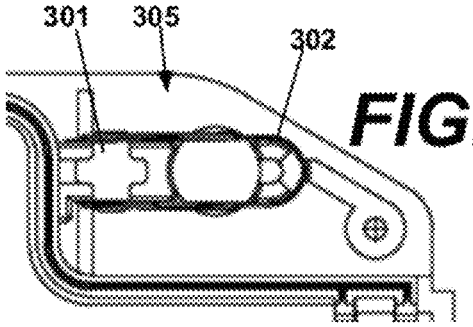
FIGS. 3A-3D are enlarged images of a section of FIG. 2 showing the latch during use in an embodiment of the invention.
Figure 3B:
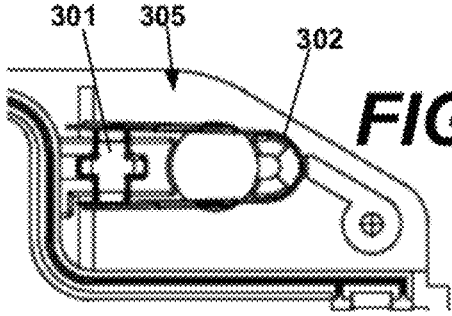
Figure 3C:
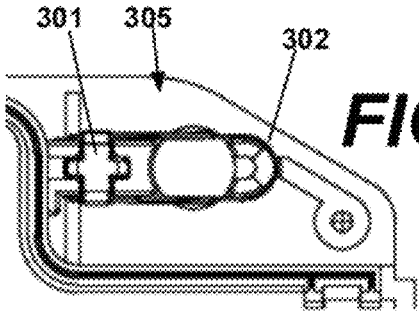
Figure 3D:
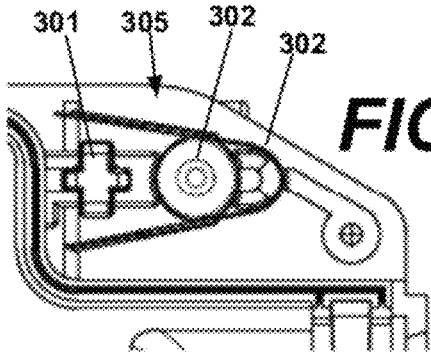

FIGS. 3A-3D are enlarged images of section 205 of FIG. 2. Renumbered 305, the enlarged section shows the internal locking spring 302 at rest (FIG. 3A), being spread open upon insertion of a locking pin 301 of the mating connector assembly 100 (FIG. 3B), latched around the barb end of the latching pins 301 (FIG. 3C), and being forced open by unlocking pins 304 (FIG. 3D).

Figure 4A:
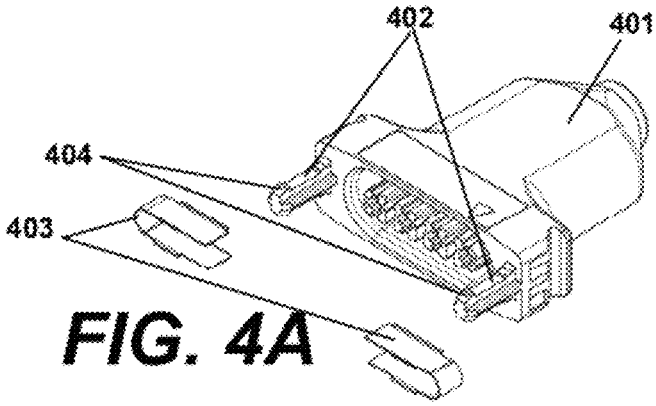
FIGS. 4A-4C are perspective views of the connector assembly during use in an embodiment of the invention.
Figure 4B:
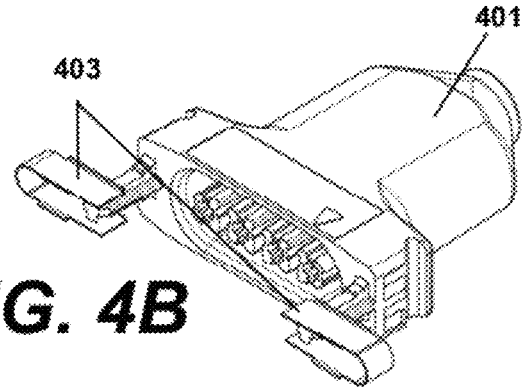
Figure 4C:
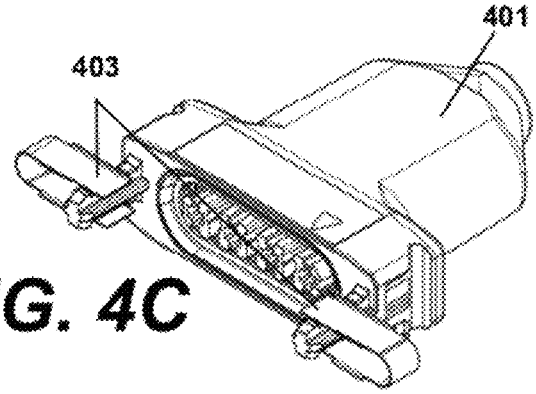

FIGS. 4A-4C show the connector assembly 400 including locking pins 402 being inserted into the connector body (not shown except for locking springs 403). In FIG. 4A, the locking pins 402 are not yet in contact with the locking springs 403. In FIG. 4B, the locking pins 402 are in contact with and are spreading open the locking springs 403. Finally, in FIG. 4C, the barb portions 404 of the locking pins 402 have passed through the locking springs 403, and the locking springs 403 have reclosed behind the barb portions 404.

Figure 5:
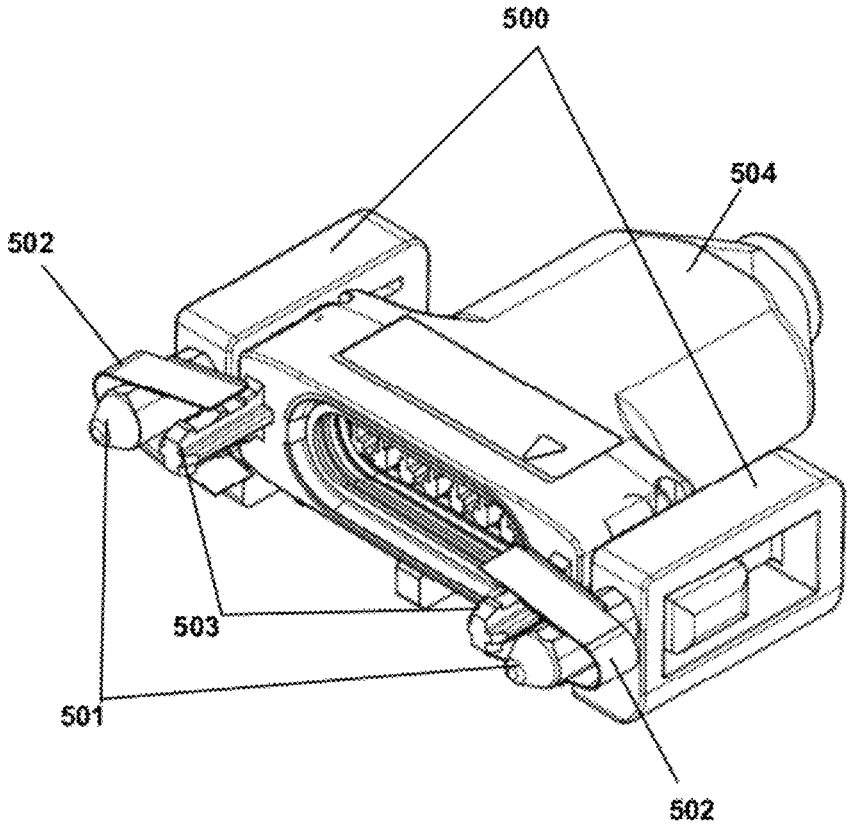
FIG. 5 is a perspective view of the latched assembly of FIG. 4C with an unlocking tool inserted into matching guide holes in the connector body.

FIG. 5 shows the latched assembly of FIG. 4C with the unlocking tool 500 being inserted into the matching guide holes in the connector body 101 (not shown in FIG. 5). As can be seen, the pins 501 of the tool 500 are inserted to spread the latching springs 502, so that they release the barb portions 503 of the latching pins. This allows the connector assembly 504 to be removed from the connector body.

Figure 6:
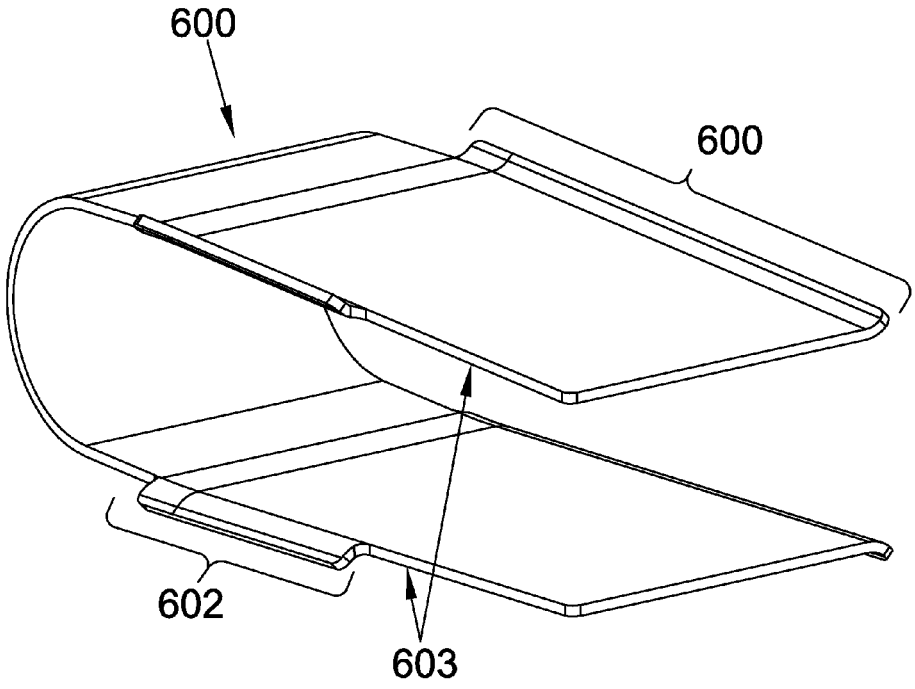
FIG. 6 is a perspective view of the latching spring according to an embodiment of the invention.

FIG. 6 is a perspective view of the latching spring 600. The latching spring 600 in the illustrated embodiment includes a formed lip 601 on both top and bottom to ease insertion of the locking pins of the mating connector (not shown), and to simplify insertion of the unlocking tool (not shown). A second formed lip 602 on top and bottom of the opposite side of spring 600 allows for easy insertion of the unlocking tool from this side alternatively. The flat bearing surface 603 of the spring 600 interface with the locking pins of a mated connector (not shown).

Figure 7:
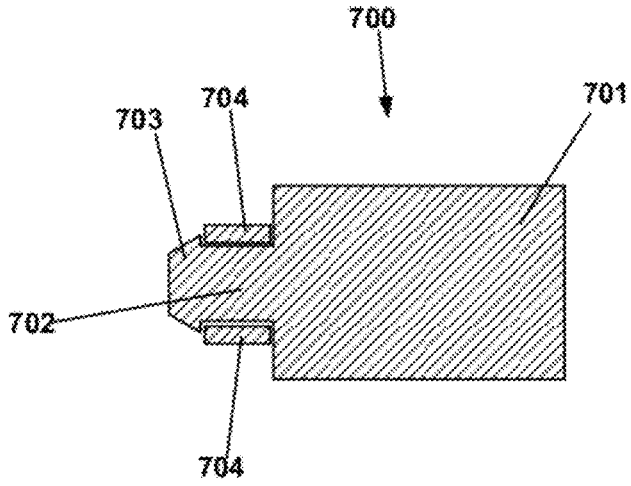
FIG. 7 shows a cross-sectional side view of the connector assembly according to an embodiment of the invention.

FIG. 7 shows a cross-sectional side view of the connector assembly 100, renumbered 700. The cross-section is taken vertically through one of the latch pins. The connector assembly 700 includes a main body portion 701 and a pin portion 702. The pin portion 703 further includes a barb portion 703 for interfering with and being locked by the prongs 704 of the locking springs.

Figure 8:
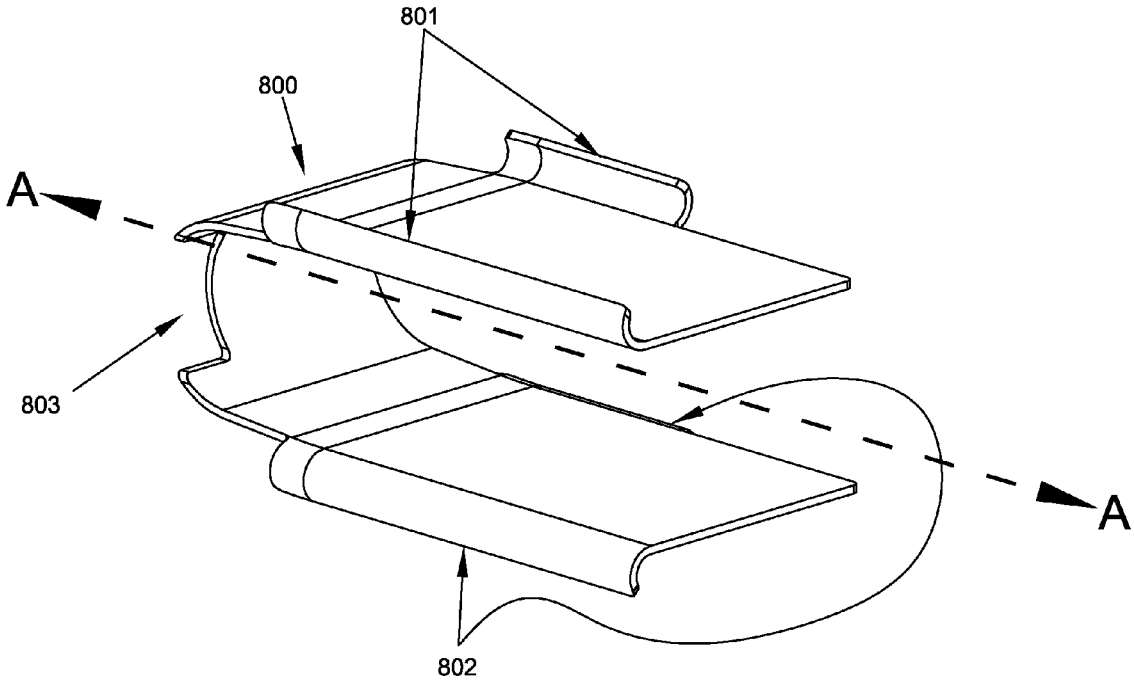
FIG. 8 is a perspective view of a latch spring according to an embodiment of the invention.
Figure 9:
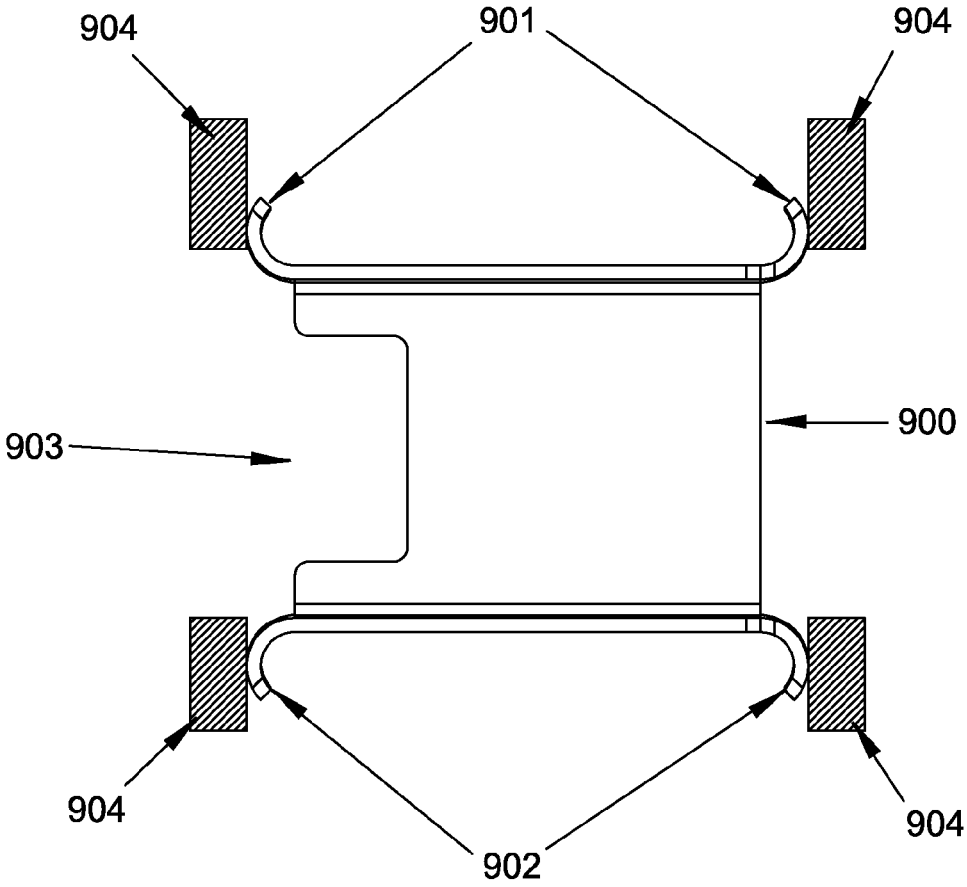
FIG. 9 is an end view of the latch spring of FIG. 8.

FIGS. 8 and 9 show optional features that may be implemented within various embodiments of the invention. In particular, FIG. 8 is a perspective view of a latch spring 800 including rounded lead-ins 801-802 in place of all lips 601-602, to avoid gouging of the connector housing wall. The perspective view of latch spring 800 also shows an optional cut-out 803, configured to engage with a key, e.g., a molded plastic key, in the connector housing to ensure that the spring 800 will not rotate inside housing. FIG. 9 shows the same structure as FIG. 8, albeit in an end view taken along direction A of FIG. 8. FIG. 9 also shows the connector housing walls 904.

Although the foregoing examples illustrate locking springs and pins at opposite sides of the assembly, it will be appreciated that the pair of locking elements may instead be located above and below the assembly, and/or that a single such locking element (latch spring and pin with barb) may be used, or that three or more such elements may be used. Although not specifically reiterated above, it will be appreciated that the described connection system is used to lock connector body and connector assembly together such that conductors in each are fixed into contact with one another. There may be one or more such conductors within each of the connector body and connector assembly, and each such conductor may carry power, signal, or both.

While the springs are preferably a metallic or other flexible material, the connector assembly and conductor body may be made of any suitable material having sufficient rigidity, moldability or formability and, if required by the application, sufficient insulating properties. Example materials for constructing these elements include plastic, e.g., thermo set or other plastic, resin, fiber-reinforced resins and plastics, and similar materials.

It will be appreciated that the foregoing description provides examples of a connection structure that is secure and user friendly, while maintaining a high cycle life and customizability through the size and strength of the included spring elements. However, it will be appreciated that other implementations of the disclosure may differ in detail from the foregoing examples. As such, all references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A latch system for lockably connecting a first conductor to a second conductor, the connector assembly comprising:

a connector assembly containing the first conductor and having one or more locking pins protruding therefrom;

a connector body containing the second conductor and having one or more internal locking springs and associated therewith one or more respective unlocking pin guides, the connector body having one or more guides for receiving the locking pins of the connector assembly, such that when the connector assembly is mated to the connector body, the one or more internal locking springs latch onto the one or more locking pins to hold the first conductor and the second conductor in mutual contact, the connector body further including one or more guides for one or more disconnect pins to receive a disconnect pin for opening the one or more latching springs and releasing the one or more locking pins to thereby release the connector assembly from the connector body.

2. The latch system according to claim 1, wherein the first and second conductors are conductors in a multi-pole AC Solar system.

3. The latch system according to claim 1, wherein the one or more disconnect pins are removably stored in the connector body.

4. The latch system according to claim 1, wherein each of the one or more locking pins protruding from the connector assembly further comprises a barb configured to be captured by the respective latching spring.

5. The latch system according to claim 1, wherein each of the one or more latching springs is an elongated open clip having a cut-out configured to interfere with a key in the connector body to prevent rotation of the spring within the connector body.

6. The latch system according to claim 1, wherein each of the one or more latching springs is an elongated open clip including one or more lips to ease insertion of the locking pins.

7. The latch system according to claim 6, wherein each of the one or more lips is rolled to prevent gouging of the connector body.

8. The latch system according to claim 1, wherein each of the one or more latching springs is an elongated open clip including one or more lips to ease insertion of the one or more disconnect pins.

9. The latch system according to claim 8, wherein each of the one or more lips is rolled to prevent gouging of the connector body.

10. A latch system for locking a connector plug to a connector socket, the connector plug having one or more conductors therein and the connector socket having respectively one or more associated conductors therein, the latch system comprising:

two locking pins protruding from the connector plug towards the connector socket when the connector plug and connector socket are positioned to be engaged;

two locking pin openings within the connector socket, the two locking pin openings being aligned with the two locking pins when the connector plug and connector socket are positioned to be engaged;

two latching springs retained within the connector socket behind the locking pin openings such that when the connector plug and connector socket are engaged, the locking pins penetrate the locking pin openings and become retained by the two latching springs; and two disconnecting pin openings within the connector socket, such that each disconnecting pin opening is situated adjacent to a locking pin opening and at least a portion of a latching spring is exposed via each disconnecting pin openings, so that penetration of the disconnecting pin openings by similarly-sized disconnecting pin will open the associated latching spring and release the associated locking pin.

11. The latch system according to claim 10, wherein the one or more conductors of the connector socket and the one or more conductors of the connector plug are conductors in a multi-pole AC Solar system.

12. The latch system according to claim 10, wherein the connector socket includes one or more ports for removably storing one or more disconnect pins.

13. The latch system according to claim 10, wherein each of the locking pins comprises a barb configured to be captured by a latching spring.

14. The latch system according to claim 10, wherein each latching spring includes a cut-out configured to interfere with a key in the connector socket to prevent rotation of the spring within the connector socket.

15. The latch system according to claim 10, wherein each latching spring includes an edge having one or more lips to ease insertion of the locking pins.

16. The latch system according to claim 15, wherein each of the one or more lips is rolled to prevent gouging of the connector socket.

17. The latch system according to claim 10, wherein each latching spring includes one or more lips to ease insertion of a disconnect pin.

18. The latch system according to claim 17, wherein each of the one or more lips is rolled to prevent gouging of the connector socket.

* * * * *